US011152137B2

(12) United States Patent
Nordin et al.

(10) Patent No.: US 11,152,137 B2
(45) Date of Patent: Oct. 19, 2021

(54) COMMUNICATIONS CABLE WITH TRIBOELECTRIC PROTECTION

(71) Applicant: Panduit Corp., Tinley Park, IL (US)

(72) Inventors: Ronald A. Nordin, Naperville, IL (US); Royal O. Jenner, Frankfort, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 16/280,170

(22) Filed: Feb. 20, 2019

(65) Prior Publication Data

US 2019/0267158 A1 Aug. 29, 2019

Related U.S. Application Data

(60) Provisional application No. 62/635,192, filed on Feb. 26, 2018.

(51) Int. Cl.
*H01B 11/04* (2006.01)
*H01B 11/10* (2006.01)
*H01B 11/08* (2006.01)

(52) U.S. Cl.
CPC ..... *H01B 11/1058* (2013.01); *H01B 11/04* (2013.01); *H01B 11/085* (2013.01); *H01B 11/1008* (2013.01)

(58) Field of Classification Search
CPC ..... H01B 11/04; H01B 11/06
USPC ..... 174/36, 113 R
See application file for complete search history.

(56) References Cited

U.S. PATENT DOCUMENTS

| | | | | |
|---|---|---|---|---|
| 3,575,748 | A * | 4/1971 | Polizzano | H01B 13/266 156/54 |
| 4,292,463 | A * | 9/1981 | Bow | B32B 15/08 174/107 |
| 4,501,928 | A * | 2/1985 | Ishitobi | B32B 15/08 174/107 |
| 6,297,454 | B1 * | 10/2001 | Gareis | H01B 11/04 174/113 C |
| 6,800,811 | B1 * | 10/2004 | Boucino | H01B 11/06 174/113 C |
| 7,335,837 | B2 | 2/2008 | Pfeiler et al. | |
| 9,697,929 | B2 * | 7/2017 | Wehrli | H01B 11/1008 |
| 10,249,410 | B1 * | 4/2019 | Lanoe | H01B 9/003 |
| 2006/0048961 | A1 * | 3/2006 | Pfeiler | H01B 11/085 174/36 |
| 2014/0238720 | A1 * | 8/2014 | Kroushl | H01B 11/04 174/113 R |

FOREIGN PATENT DOCUMENTS

WO 2018071774 A1 4/2018

* cited by examiner

*Primary Examiner* — Chau N Nguyen
(74) *Attorney, Agent, or Firm* — Christopher S. Clancy; James H. Williams; Peter S. Lee

(57) ABSTRACT

A communications cable has a plurality of twisted pairs of insulated conductors, metal foil tape between the twisted pairs, and a cable jacket are disclosed. The metal foil tape can include a substrate, a metal layer on the substrate, and a triboelectric coating on at least the metal layer of the metal foil tape. The triboelectric coating has a charge affinity closer to a charge affinity of the insulated conductors than a charge affinity of the metal layer to prevent charge build up between the conductors and the metal foil tape.

4 Claims, 2 Drawing Sheets

COMMUNICATIONS CABLE WITH TRIBOELECTRIC PROTECTION

CROSS-REFERENCE TO RELATED APPLICATIONS

This application claims priority to U.S. Provisional Application No. 62/635,192, filed Feb. 26, 2018, the subject matter of which is hereby incorporated by reference in its entirety.

BACKGROUND

As networks become more complex and have a need for higher bandwidth cabling, attenuation of cable-to-cable crosstalk (or "alien crosstalk") becomes increasingly important to provide a robust and reliable communications system. Alien crosstalk is primarily coupled electromagnetic noise that can occur in a disturbed cable arising from signal-carrying cables that run near the disturbed cable, and, is typically characterized as alien near end crosstalk (ANEXT), or alien far end crosstalk (AFEXT).

BRIEF DESCRIPTION OF THE DRAWINGS

The following detailed description references the drawings, wherein.

DETAILED DESCRIPTION

Figure 1:
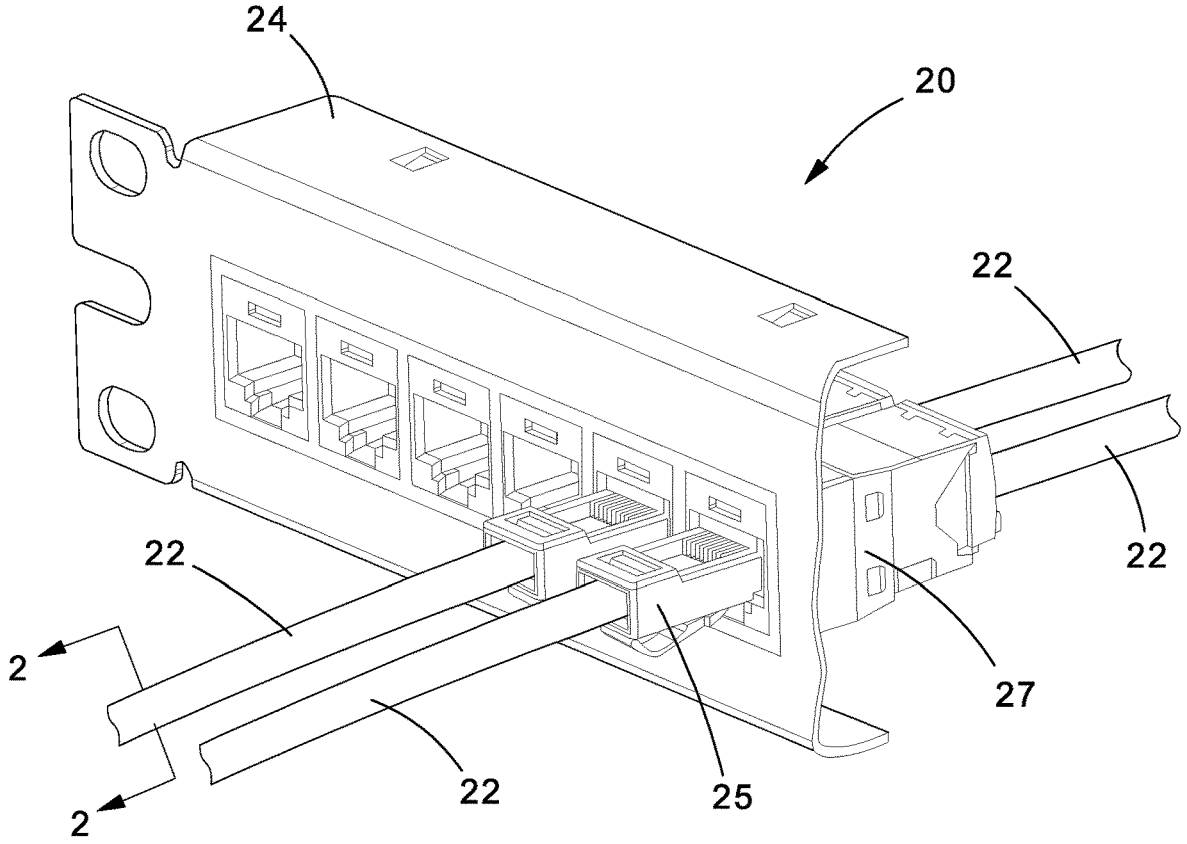
FIG. 1 is an illustration of a perspective view of a communications system.

Reference will now be made to the accompanying drawings. Wherever possible, the same reference numbers are used in the drawings and the following description to refer to the same or similar parts. It is to be expressly understood, however, that the drawings are for the purpose of illustration and description only. While several examples are described in this document, modifications, adaptations, and other implementations are possible. Accordingly, the following detailed description does not limit the disclosed examples. Instead, the proper scope of the disclosed examples may be defined by the appended claims.

FIG. 1 is a perspective view of a communications system 20, which includes at least one communications cable 22 connected to equipment 24. Equipment 24 is illustrated as a patch panel in FIG. 1, but the equipment can be passive equipment or active equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers/telecommunications rooms; security devices (cameras and other sensors, etc.) and door access equipment; and telephones, computers, fax machines, printers and other peripherals as can be found in workstation areas. Communications system 20 can further include cabinets, racks, cable management and overhead routing systems, and other such equipment.

Communications cable 22 is shown in the form of an unshielded twisted pair (UTP) cable, and more particularly a Category 6A cable which can operate at speeds of 10 Gb/s, as is shown more particularly in FIG. 2, and which is described in more detail below. Communications cable 22 may, however, be a variety of other types and categories of communications cables, as well as other types of cables. Cables 22 can be terminated directly into equipment 24, or alternatively, can be terminated in a variety of plugs 25 or jack modules 27 such as an RJ45 type, jack module cassettes, and many other connector types, or combinations thereof. Further, cables 22 can be processed into looms, or bundles, of cables, and additionally can be processed into pre-terminated looms.

Communications cable 22 can be used in a variety of structured cabling applications including patch cords, backbone cabling, and horizontal cabling, although the present invention is not limited to such applications. In general, the present invention can be used in military, industrial, telecommunications, computer, data communications, and other cabling applications.

Figure 2:
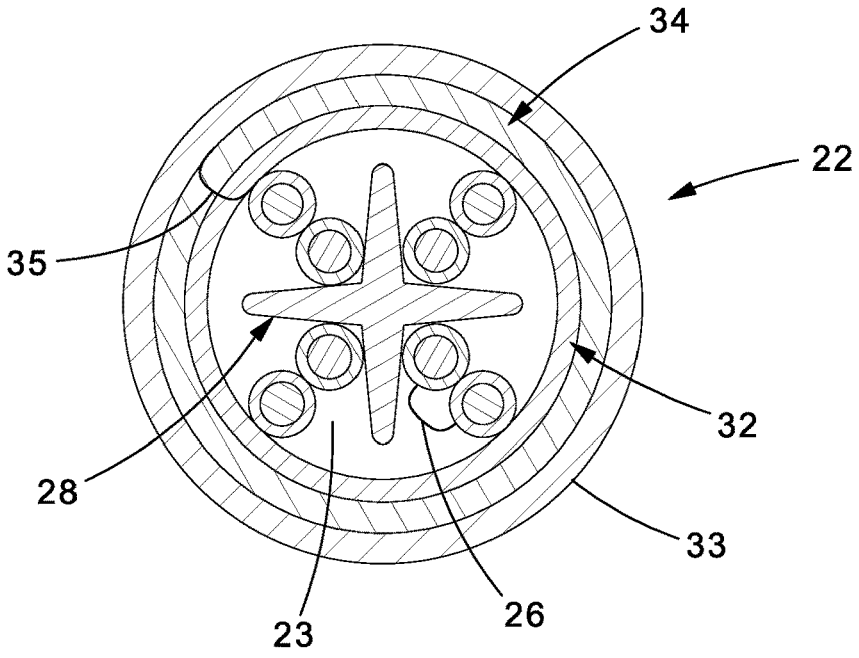
FIG. 2 is an illustration of a cross-sectional view of a communications cable.

Referring to FIG. 2, there is shown a transverse cross-section of cable 22, taken along section line 2-2 in FIG. 1. Cable 22 may include a cable jacket 33 made from a plastic polymer such as polyvinyl chloride (PVC), and an inner core 23 with four twisted conductive wire pairs 26 that are separated with a pair separator 28. Each wire in wire pairs 26 may be an insulated conductor having a conducting core (e.g., copper) surrounded by an insulator such as polytetrafluoroethylene (PTFE).

Figure 3:
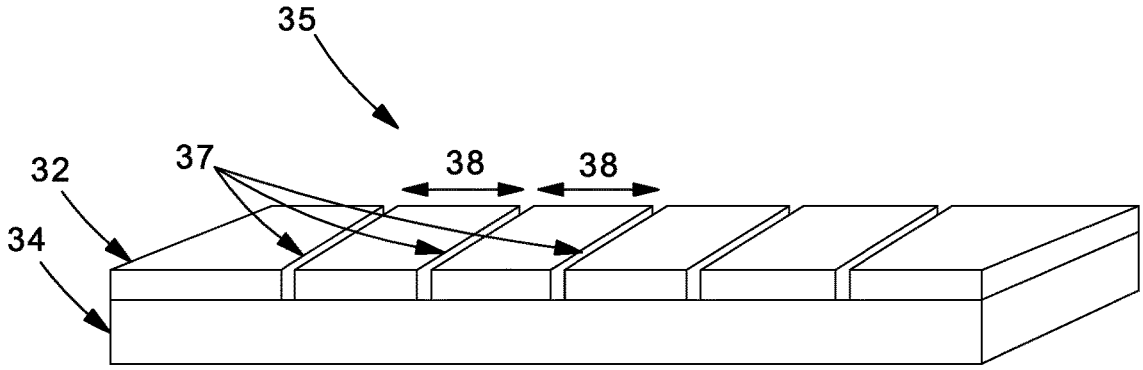
FIG. 3 is an illustration of a perspective view of a discontinuous metal foil tape.

Metal foil tape 35 may be longitudinally wrapped around core 23 under cable jacket 33 along the length of communications cable 22. That is, metal foil tape 35 may be wrapped along its length such that it wraps around the length of communications cable 22 in a "cigarette" style wrapping or may be spirally wrapped along the length of communications cable 22. As shown in FIG. 3, metal foil tape 35 may comprise a metal layer 32 (e.g., aluminum) adhered to a polymer film (e.g., polyethylene terephthalate, or PET) substrate 34. In some implementations, metal layer 32 may be adhered to substrate 34 with an adhesive. Metal foil tape 35 may be a discontinuous metal foil tape, in that discontinuities 37 may be created in metal layer 32, for example, in a post-processing step where lasers are used to ablate portions of metal layer 32. As a result, a plurality of discontinuous segments 38 are formed in metal layer 32. Discontinuous segments 38 may take on various shapes and forms. For example, discontinuous segments 38 may be the same size and shape, repeating patterns of different sizes and shapes, or random or pseudorandom arrangements of different sizes and shapes.

In some situations, communications cable 22 may be used in applications where cable 22 is constantly moved or displaced, such as at a workspace or desk, or as a result of movement of equipment in an equipment room. The movement of cable 22 may cause some of the internal components of cable 22 to move with respect to other internal components. For example, as cable 22 moves and bends, wire pairs 26 may move relative to metal foil tape 35, and thus may rub against metal foil tape 35. Similarly, metal foil tape 35 may also rub against cable jacket 33. The rubbing of various surfaces against one another in communications cable 22 can cause electric charge to build up in cable 22 via the triboelectric effect. The charge buildup occurs in part due to the differences in charge affinity between the rubbing surfaces in communications cable 22. A large enough difference in charge affinity between two surfaces can cause enough of a charge buildup to damage devices that are connected to communications cable 22 as well as cause bit errors when information is passing through cable 22.

In the context of the construction of communications cable 22, metal layer 32 may have a slightly positive charge affinity whereas the PTFE insulator surrounding the conductors in wire pairs 26 it faces in communications cable 22 may have a charge affinity of around −190 nC/J, which produces a significant difference in charge affinity of greater than 190 nC/J. On the opposite side of metal foil tape 35, PET substrate 34 may have a charge affinity of around −40 nC/J whereas PVC cable jacket 33 may have a charge affinity of around −100 nC/J, which produces a net difference in charge affinity of around 60 nC/J. The larger the charge affinity difference between the two materials is, the larger the charge buildup and eventual discharge of energy will occur.

Figure 4:
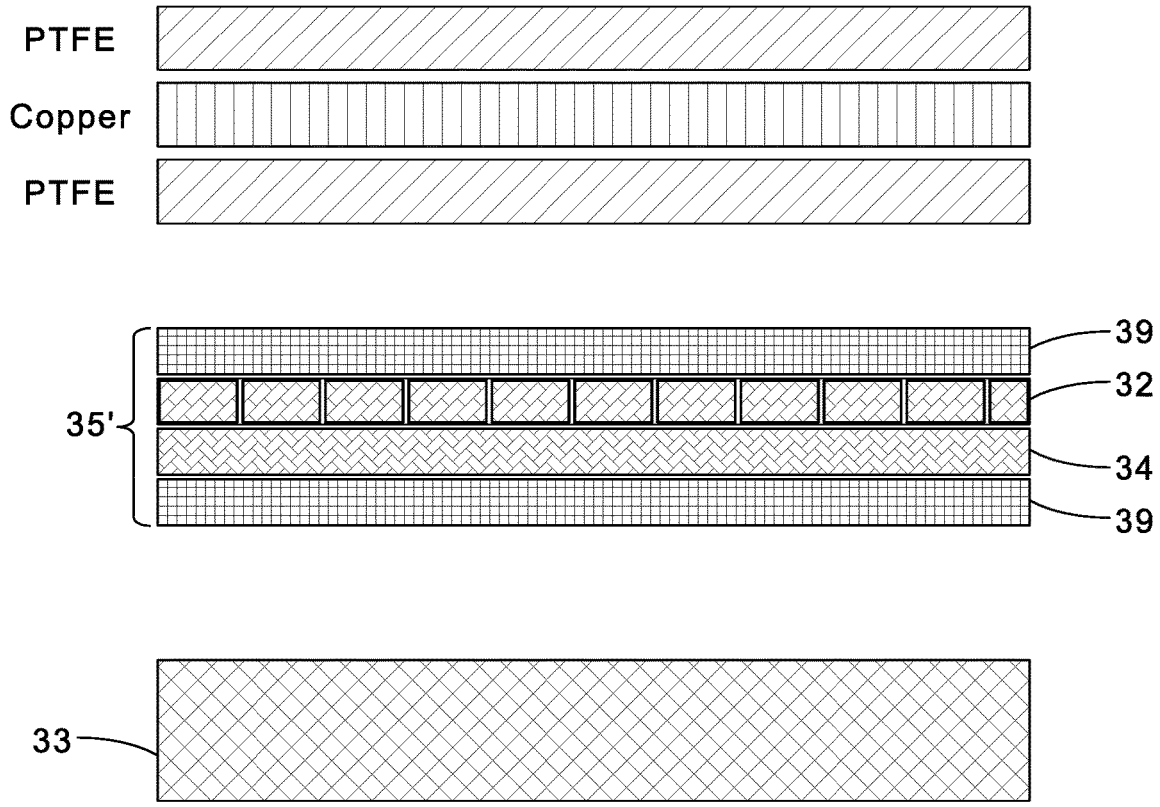
FIG. 4 is an illustration of a cross-sectional view of the discontinuous metal foil tape of FIG. 3 with a triboelectric coating applied.

As shown in FIG. 4, a triboelectric coating 39 may be applied to metal foil tape 35 to form metal foil tape 35'. Triboelectric coating 39 may be a coating that minimizes the triboelectric effect (i.e., electrical charge buildup due to the rubbing of one surface against another) between various surfaces within communications cable 22 by reducing the differences in charge affinity between the surfaces. Triboelectric coating 39 may be applied to one or both sides of metal foil tape 35 such that at least one of the top of metal layer 32 and the top of substrate 34 is covered by triboelectric coating 39. In some implementations, triboelectric coating 39 may be a strip-type film instead of a coating, and may be a solid coating/film or a patterned coating/film (e.g., waffled pattern, dotted pattern, striped pattern, etc.). In some implementations, triboelectric coating 39 may be applied before or after metal layer 32 is cut into discontinuous segments. When applied prior to the cutting, triboelectric coating 39 on metal layer 32 is cut into discontinuous segments along with metal layer 32.

The same material can be used on both sides of metal foil tape 35 to simplify the tape fabrication process, or each side can be coated with a different material to optimize the charge affinities of each side of metal foil tape 35. The material used for triboelectric coating 39 may be selected such that triboelectric coating 39 will have a charge affinity close to the charge affinity of the insulator surrounding the conductors in wire pairs 26 as well as the charge affinity of cable jacket 33. In one example, triboelectric coating 39 may be made of a polyolefin material having a charge affinity of around −90 nC/J, which may be effective in minimizing the triboelectric effect between it and PVC cable jacket 33. In another example, triboelectric coating 39 may be made of an ethylene propylene based rubber (or other rubber type materials such as Butyl, Hypalon, or Santoprene) having a charge affinity of around −140 nC/J, which may be effective in minimizing the triboelectric effect between it and the PTFE insulation of wire pairs 26.

With a polyolefin material triboelectric coating 39 applied to both sides of metal foil tape 35, the difference in charge affinity between the PTFE insulator of wire pairs 26 and metal layer 32 of the resulting metal foil tape 35' is now around 100 nC/J (−90 nC/J coating against −190 nC/J PTFE), which is a reduction of around 47%. The difference in charge affinity between PVC cable jacket 33 and PET substrate 34 of metal foil tape 35 is now around 10 nC/J (−90 nC/J coating against −100 nC/J PVC), which is a reduction of around 83%.

With a polyolefin material triboelectric coating 39 applied to the substrate 34 side of metal foil tape 35 and an ethylene propylene material triboelectric coating 39 applied to the metal layer 32 side of metal foil tape 35, the difference in charge affinity between the PTFE insulator of wire pairs 26 and metal layer 32 of the resulting metal foil tape 35' is now around 50 nC/J (−140 nC/J coating against −190 nC/J PTFE), which is a reduction of around 74%. The difference in charge affinity between PVC cable jacket 33 and PET substrate 34 of metal foil tape 35 is now around 10 nC/J (−90 nC/J coating against −100 nC/J PVC), which is a reduction of around 83%.

Note that while the present disclosure includes several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and, should instead be understood as potentially combinable if such combinations are permissive. It should also be noted that there are many alternative ways of implementing the embodiments of the present disclosure. It is therefore intended that claims that may follow be interpreted as including all such alterations, permutations, and equivalents as fall within the true spirit and scope of the present disclosure.

The invention claimed is:

1. A communications cable, comprising:

a jacket;

a cable core comprising a plurality of twisted pairs of conductors and a separator positioned to separate each of the twisted pairs in the plurality of twisted pairs, wherein each of the conductors are covered, at least in part, by an insulation material; and a metal foil tape disposed around the cable core to surround the plurality of twisted pairs of conductors and positioned between the cable core and the jacket within the communications cable, the metal foil tape comprising:

a metal layer;

a first triboelectric coating applied directly on a first surface of the metal layer, wherein the first surface of the metal layer faces towards the cable core, wherein the first triboelectric coating comprises a polyolefin material;

a substrate disposed onto a second surface of the metal layer as a second layer, wherein the second surface of the metal layer is opposite the first surface of the metal layer;

a second triboelectric coating applied on a surface of the substrate; and wherein a charge affinity of the first triboelectric coating and a charge affinity of the insulation material surrounding each of the plurality of twisted pairs of conductors within the cable core are closer together than the charge affinity of the insulation material surrounding each of the plurality of twisted pairs of conductors within the cable core and a charge affinity of the metal layer, and wherein a charge affinity of the second triboelectric coating and a charge affinity of the jacket are closer together than the charge affinity of the jacket and a charge affinity of the substrate; and wherein the second triboelectric coating is different from the substrate.

2. The communications cable of claim 1, wherein the metal layer includes cuts that create discontinuous regions in the metal layer.

3. The communications cable of claim 1, wherein the second triboelectric coating comprises a polyolefin material.

4. The communications cable of claim 1, wherein the second triboelectric coating comprises an ethylene propylene material.

* * * * *